US006774582B1

(12) United States Patent
Kwong et al.

(10) Patent No.: US 6,774,582 B1
(45) Date of Patent: Aug. 10, 2004

(54) LIGHT DIMMING CONTROL METHOD AND APPARATUS

(75) Inventors: Allan Kwong, Shatin (HK); Xiao Chen Chen, Zhongshan (CN)

(73) Assignee: Regal King Manufacturing Limited, Kowloon Bay (HK)

( * ) Notice: Subject to any disclaimer, the term of this patent is extended or adjusted under 35 U.S.C. 154(b) by 0 days.

(21) Appl. No.: 10/348,042

(22) Filed: Jan. 17, 2003

(51) Int. Cl.[7] ..... H05B 37/02
(52) U.S. Cl. ..... 315/293; 315/295; 315/DIG. 4
(58) Field of Search ..... 315/293, 295, 315/294, 316, DIG. 4

(56) References Cited

U.S. PATENT DOCUMENTS 5,530,322 A * 6/1996 Ference et al. ..... 315/295

* cited by examiner

*Primary Examiner*—David Vu
(74) *Attorney, Agent, or Firm*—Baker, Donelson, Bearman, Caldwell & Berkowitz

(57) ABSTRACT

Push and release switch operation with a light off causes the light to dim up. Push and release operation with the light on causes it to dim up or to dim down dependant on the level of light intensity when first pushed and held.

12 Claims, 4 Drawing Sheets

LIGHT DIMMING CONTROL METHOD AND APPARATUS

TECHNICAL FIELD

This invention relates to methods and apparatuses for controlling the intensity of lights.

BACKGROUND OF THE INVENTION

Lights today are often controlled by dimmers rather than by simple on-off switches. Their use enables the intensity of lights to be adjusted to the preference of a user by means other than changes in bulbs and in their power. Exemplary of such dimmers are those shown in U.S. Pat. Nos. 3,037,146, 3,173,031, 3,935,505, 4,090,167, 4,939,383, 6,005,308, and 6,300,727.

Heretofore dimmers have commonly employed multiple switches or single switches with multiple mechanical functions. For example, some dimmers have had an on-off switch and a rheostat. Others have had a single switch that is depressed for on-off operations and twisted for dimming by rheostat operation. Problems with these arise from the fact that a switch-on operation may not cause the light to come on as the dimmer may be positioned in its full dim position. Some have required repeated dimming adjustments when the same level of intensity is repeatedly desired. Those that do repeat a prior intensity do so instantaneously, whether or not such is desired.

Accordingly, it is seen that a dimmer that adjusts light in a more natural manner without unwanted abrupt changes in intensity and guess work on the part of its user has long remained desired. It is to the provision of such that the present invention is primarily directed.

SUMMARY OF THE INVENTION

In a preferred form of the invention the intensity of a light is controlled with a manual push to actuate switch. A push and release switch operation with the light off causes the light to dim up to a first preset level of intensity. A push and release switch operation with the light on causes the light to dim down to a light off condition. A push and hold switch operation with the light on causes the light to dim up towards a preset maximum intensity or to dim down towards a light off condition dependant upon the level of light intensity when first pushed and held relative to a second preset level of intensity.

In another preferred form of the invention light dimmer control apparatus comprising a manual switch mechanically biased to a switch off position, first electric circuit means for dimming a light up to a first preset level of intensity in response to a push and release operation of said switch, in a light off condition; second electronic circuit means for dimming the light to a light off condition in response to a push and release operation of said switch in a light on condition; and third electronic circuit means for dimming the light up or down in response to a push and hold operation of said switch.

DETAILED DESCRIPTION

The dimmer operates in the following manner from the perspective of its user. It is operable by a single switch such as one that employs a spring biased push button. In a light off condition one may push and release, such as within a span of a second, whereupon the light gradually dims up from its fully off condition to the intensity that it was previously at when turned off. Push and release again and the light dims gradually down to a full off state. If instead of pushing and releasing the user pushes and holds the button against its spring-back bias beyond the one second time, then the intensity of the light is changed. If this is done during a dim up or dim down operation that was initiated with a push and release operation, then the light will continue to dim up to maximum intensity or dim down to its off condition. If, as is more common, a push and hold operation is commenced with the light on and its intensity steady, then the light will dim up or down for as long as the button is held depressed until it reaches a maximum light on or off state or is released. Whether the light dims up or down depends on whether its intensity was above or below a preset level such as 50%. If pushed and held with the light intensity steady above 50%, then it will dim down since it is presumed that its users probably wishes it lower. If below 50%, the reverse occurs.

Figure 1:
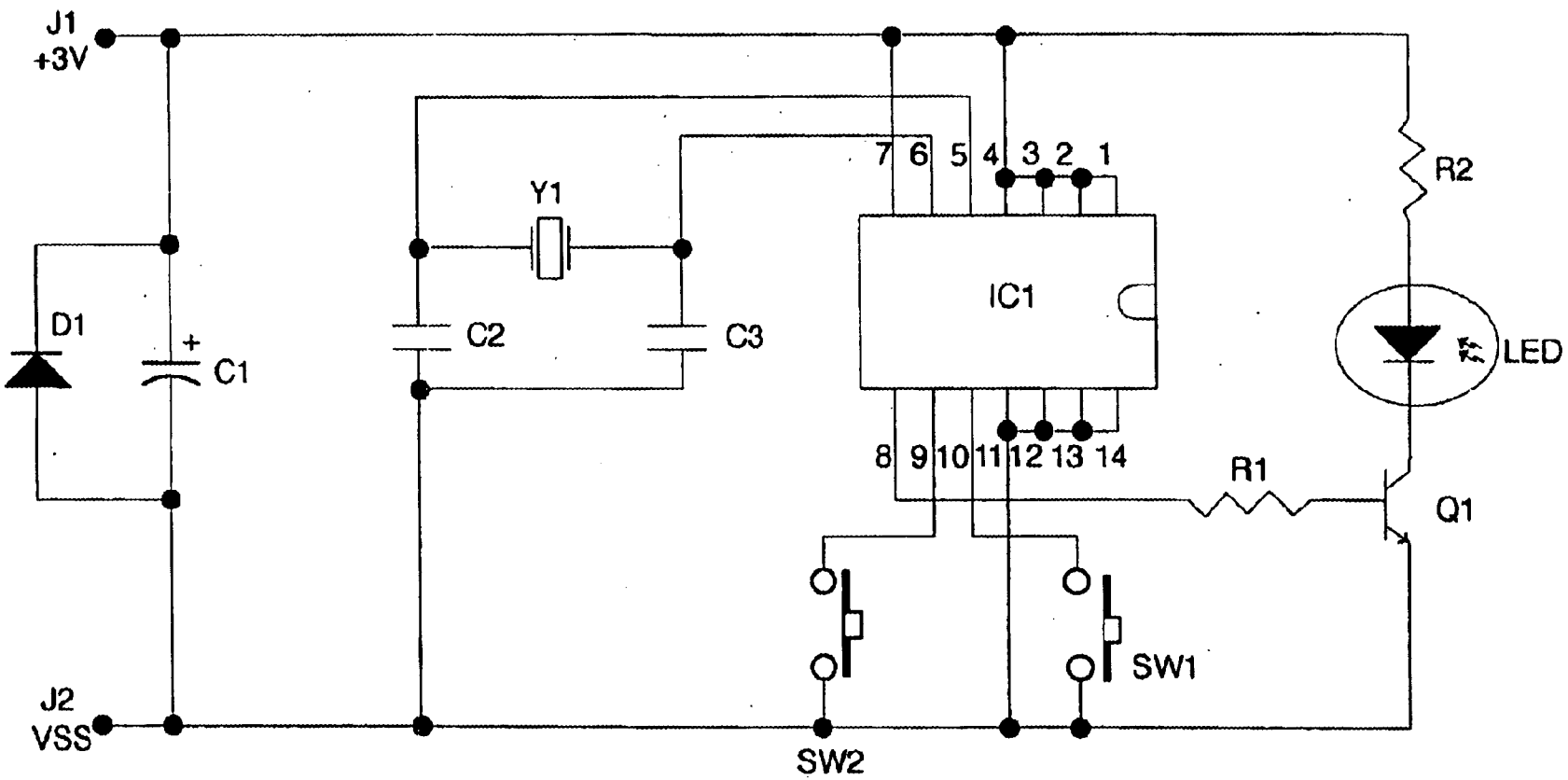
FIG. 1 is a circuit diagram of the remote control unit of a dimmer that embodies principles of the invention in its preferred form.
Figure 2:
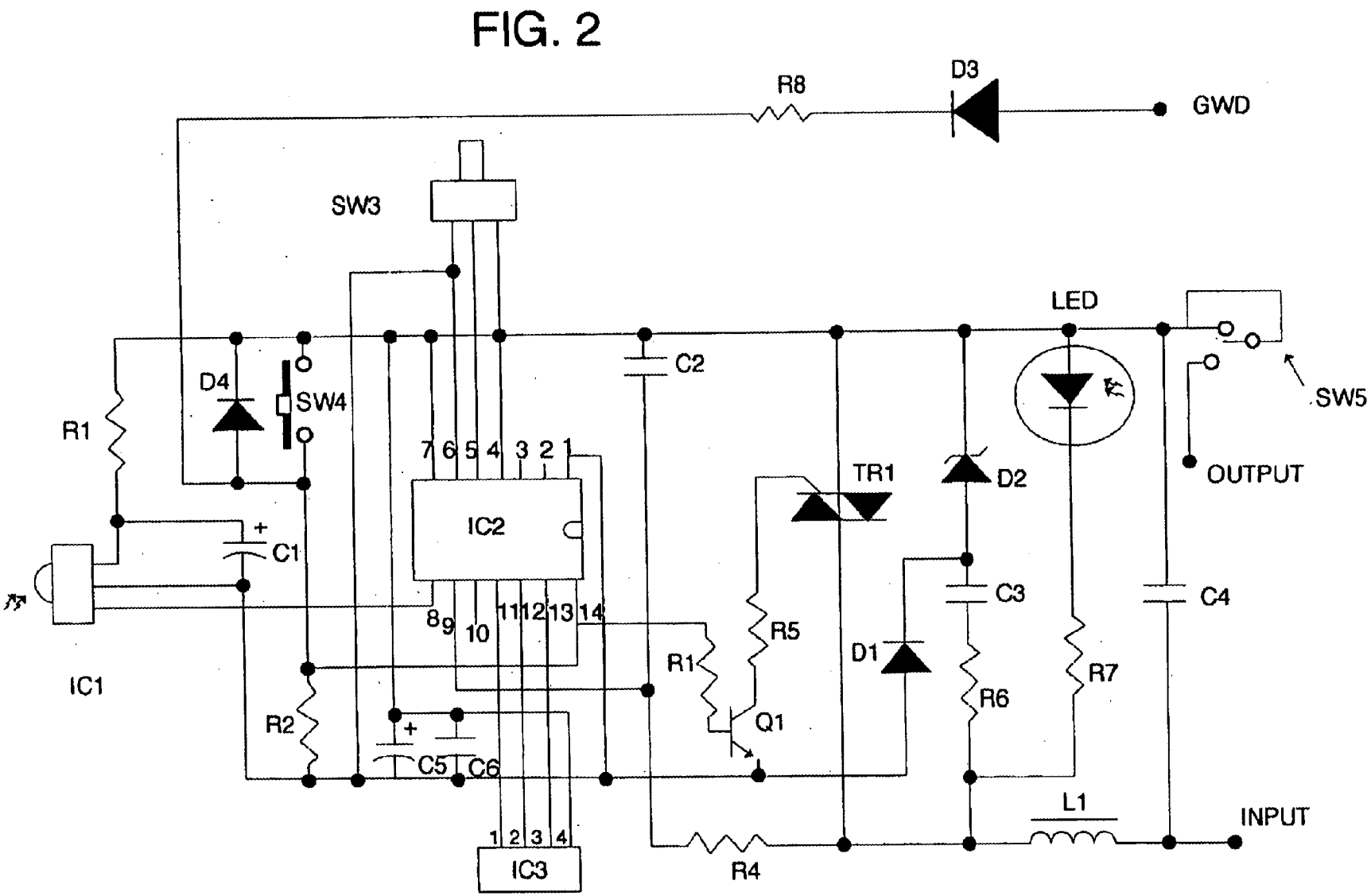
FIG. 2 is a circuit diagram of the receive unit of the dimmer.

Although it need not be, the dimmer is preferably controlled by a remote controller and a receiver. A preferred form of the remote controller or transmitter is schematically shown in FIG. 1. A preferred form of the receiver is schematically shown in FIG. 2.

Communication between the remote and receiver is preferably made by infrared signals. When powered by a 3-volt battery, pin 4 of the remote controller, 1C-1 is a +3 VDC. Pin 11 is negative VSS. Pins 9 and 10 are high and the microprocessor is in its sleeping mode to conserve power. Upon switch operation pin 9 or 10 enters a zero level, the sleeping mode is terminated and, depending on which pin has gone 0, a 38 KHz encoded signal is generated from pin 8 and transmitted as infrared light from the LED. Upon a push and release of switch SW1 or SW2, dependant upon which of two channels is selected, three sets of encoded signals are transmitted. Upon a push and hold, the signals are continued to be transmitted until manual release whereupon the microprocessor is returned to its sleeping mode.

An instructional signal here from the remote LED consists of three sets of signals each of which consists of eight pulses. This enhances coding and decoding by minimizing transmissions and interference errors. This also lessens the need for a strong infrared filer.

The receiver microprocessor I2, is programmed to receive, enlarge and fix an output signal from the remote once its manual on/off operation switch SW4 is turned on to a line power source and switch SW3 switched to the selector remote channel. Switch SW is the main power switch which of course must be on for the remote to control it. When a 38 KHz infrared signal is received pin 1 will be at 0. This microprocessor provides a dimming signal processing center. Pin 4 of it is at +5 VDC supply. Pin 11 is grounded. A 60 Hz input is provided to pin 9. Pin 5 provides for channel selector while pin 10 is the dimming control output. Pin 14 is for on/off control. Normally pin 14 is at zero, pin 8 is at high and pin 9 is at 120 VAC.

When switch SW4 is held down, pin 14 is high. If high for more than 500 microseconds, 1C-2 will enter a dimming status. 1C-2 will then cause output pulses generated at pin 10 in controlling the conduction angle of the TRIAC for dimming. When 1C-2 terminates signal output, the TRIAC is turned off and the level of light intensity stored in memory.

Figure 3:
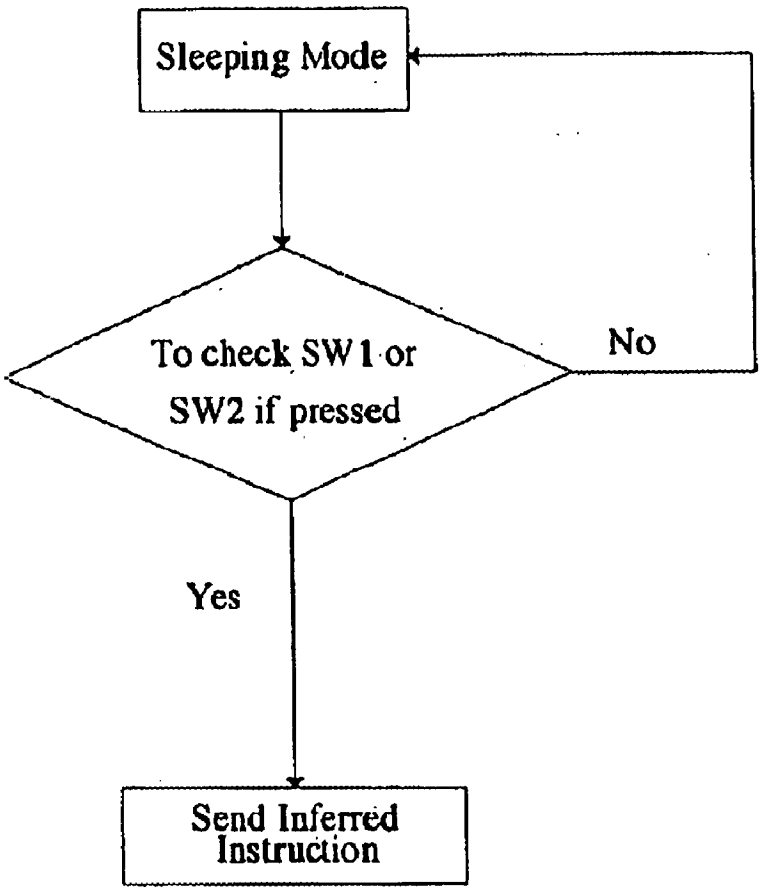
FIG. 3 is a flow chart of a dimmer remote unit operational microprocessor program.
Figure 4:
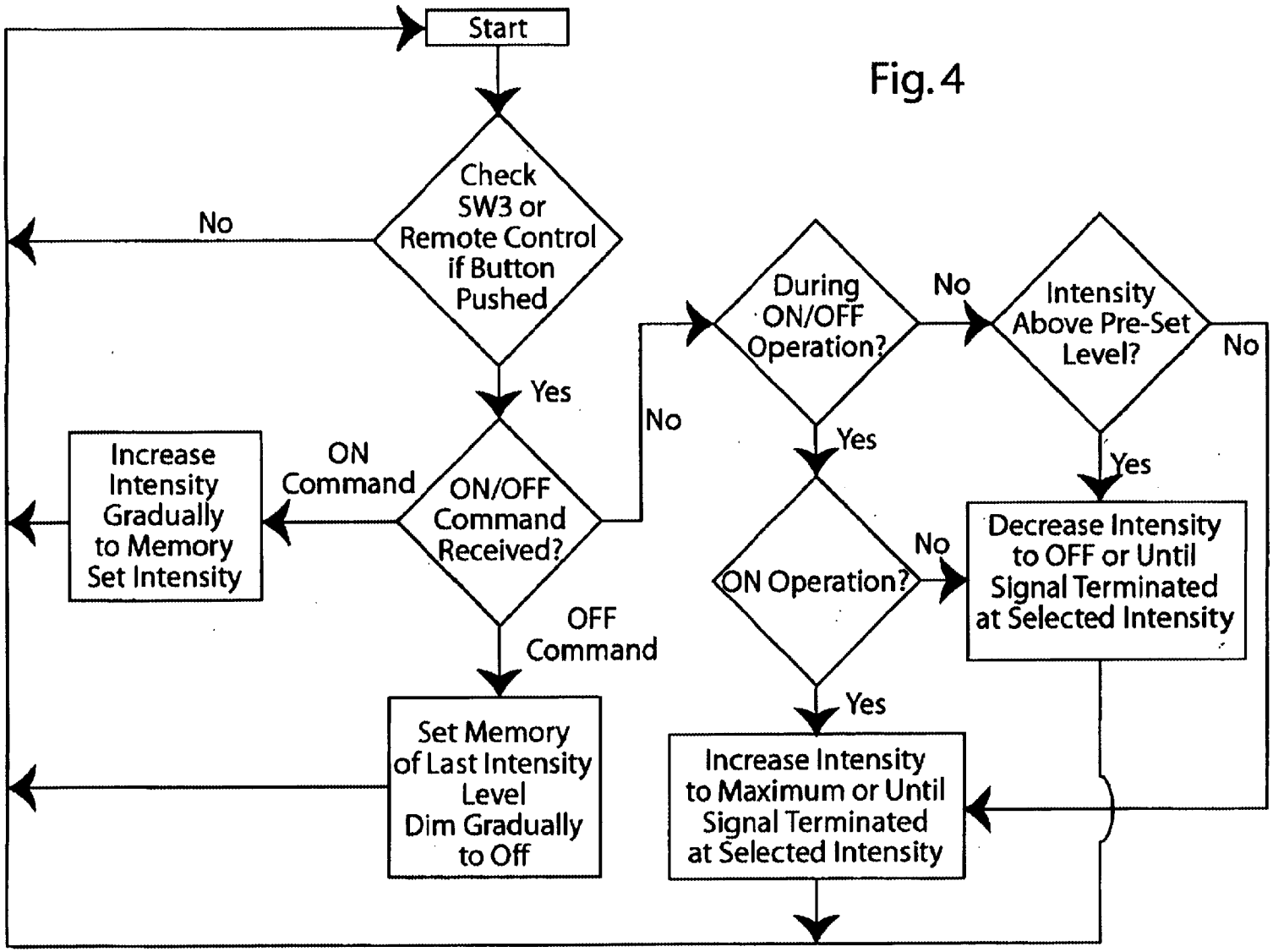
FIG. 4 is a flow chart of a dimmer receiver unit operational microprocessor program.

A flow chart for the remote microprocessor program is shown in FIG. 3 while one for the receiver microprocessor is shown in FIG. 4. A preferred set of values for the discrete components of the circuits is shown in Tables 1 and 2.

TABLE 1

| REMOTE | |
|---|---|
| 1C-1 | EE 339E |
| R1 | 1 K ohms |
| R2 | 0.05 ohms |
| C1 | 47 microfarads |
| C2 | 68 picafarads |
| C3 | 68 picafarads |

TABLE 2

| RECEIVER | |
|---|---|
| R1 | 330 ohms |
| R2 | 68 K ohms |
| R3 | 10 K ohms |
| R4 | 750 K ohms |
| R5 | 100 ohms |
| R6 | 100 ohms |
| R7 | 150 K ohms |
| R8 | 47 K ohms |
| C1 | 100 microfarads |
| C2 | 102 microfarads |
| C3 | 334 microfarads |
| C4 | 333 microfarads |
| C5 | 220 microfarads |
| C6 | 104 microfarads |
| 1C1 | LT 0038A |
| 1C2 | EE 339D |
| 1C3 | Not used (dummy) |

It thus is seen that a method and apparatus is now provided for use in dimming lights in a natural manner with manual operation of a single button. Although the invention has been shown and described in its preferred form, it should be understood that modifications or additions may be made without departure from the spirit and scope of the invention as shown in the following claims.

What is claimed is:

1. A method of controlling the intensity of a light with a manual push to actuate switch wherein push and release switch operation with the light off causes the light to dim up to a first preset level of intensity, and wherein push and release switch operation with the light on causes the light to dim down to a light off condition, and wherein push and hold switch operation with the light on causes the light to dim up towards a preset maximum intensity or to dim down towards a light off condition dependant upon the level of light intensity when first pushed and held relative to a second preset level of intensity.

2. The control method of claim 1 wherein the first preset level of intensity was set by the intensity existent at the prior light off switch operation.

3. The control method of claim 1 wherein termination of a push and hold switch operation sets the light intensity existing at the time of termination.

4. The control method of claim 1 wherein the second preset level of intensity is set at 50% of the first preset level of intensity.

5. The control method of claim 1 wherein with the light on push and hold switch operation causes the light to dim down if the intensity is above the second preset level of intensity or causes the light to dim up if the intensity then is below the second preset level of intensity.

6. The control method of claim 1 conducted with an infrared remote controller and infrared receiver that is hard wired to the light.

7. Light dimmer control apparatus comprising a manual switch mechanically biased to a switch off position, first electric circuit means for dimming a light up to a first preset level of intensity in response to a push and release operation of said switch, in a light off condition; second electronic circuit means for dimming the light to a light off condition in response to a push and release operation of said switch in a light on condition; and third electronic circuit means for dimming the light up or down in response to a push and hold operation of said switch.

8. The light dimmer control apparatus of claim 7 wherein said first and second electric circuit means include microprocessor means with memory for remembering the level of light intensity existent when a push and release dimdown operation was initiated thereby establishing the first preset level of intensity for a subsequent light on switch operation.

9. The light dimmer control apparatus of claim 7 wherein said manual push to operate switch is mounted on a mobile remote controller with (a) a power source, (b) a remote microprocessor, and (c) an infrared emitter controlled by said remote microprocessor.

10. The light dimmer control apparatus of claim 9 further comprising another microprocessor connectable with the light and in infrared sensor coupled with said another microprocessor.

11. The light dimmer apparatus of claim 10 wherein said microprocessor and said another microprocessor are programmed to encode and decode infrared signals in pulse trains comprised of at least three pulses each.

12. The light dimmer apparatus of claim 11 wherein each set transmitted and received in approximately 50 ms and are spaced apart approximately 100 ms.

* * * * *

UNITED STATES PATENT AND TRADEMARK OFFICE

CERTIFICATE OF CORRECTION

PATENT NO. : 6,774,582 B1
DATED : August 10, 2004
INVENTOR(S) : Kwong et al.

It is certified that error appears in the above-identified patent and that said Letters Patent is hereby corrected as shown below:

Column 4,
Line 51, after "set" insert -- of three pulses are --

Signed and Sealed this

Thirtieth Day of November, 2004

JON W. DUDAS
*Director of the United States Patent and Trademark Office*